United States Patent [19]

Johnson et al.

[11] 4,034,564

[45] July 12, 1977

[54] PISTON PUMP ASSEMBLY HAVING LOAD RESPONSIVE CONTROLS

[75] Inventors: Howard L. Johnson, Joliet; Walter Z. Ruseff, New Lenox, both of Ill.

[73] Assignee: Caterpillar Tractor Co., Peoria, Ill.

[21] Appl. No.: 651,885

[22] Filed: Jan. 23, 1976

[51] Int. Cl.[2] ..... F16D 31/02

[52] U.S. Cl. ..... 60/445; 60/451; 60/452; 417/218

[58] Field of Search ..... 60/445, 451, 452; 417/218, 213, 222

[56] References Cited

U.S. PATENT DOCUMENTS

| | | | |
|---|---|---|---|
| 2,892,312 | 6/1959 | Allen et al. | 60/427 |
| 3,350,881 | 11/1967 | D'Amato | 417/222 |
| 3,401,521 | 9/1968 | Plate | 60/451 |
| 3,406,850 | 10/1968 | Hancox | 60/452 |
| 3,444,689 | 5/1969 | Budzich | 60/445 |
| 3,797,245 | 3/1974 | Hein | 60/452 |
| 3,809,501 | 5/1974 | Weisenbach | 417/222 |
| 3,834,836 | 9/1974 | Hein et al. | 417/222 |
| 3,861,145 | 1/1975 | Hall et al. | 60/445 |

*Primary Examiner*—Carlton R. Croyle
*Attorney, Agent, or Firm*—Frank L. Hart

[57] ABSTRACT

A piston pump having a housing and an angularly adjustable swash plate for controlling piston displacement and the flow of fluid discharged from the pump has improved control means for controllably positioning the swash plate in response to a modified load pressure signal.

6 Claims, 3 Drawing Figures

PISTON PUMP ASSEMBLY HAVING LOAD RESPONSIVE CONTROLS

BACKGROUND OF THE INVENTION

The present invention relates to variable displacement axial piston pumps and pertains particularly to a variable displacement axial piston pump having displacement control means which are automatically operative to maintain and infinitely vary displacement of said pump.

Variable displacement pumps are often utilized in earth moving and other heavy duty machinery because pump flow and system pressure can be varied to meet system demands. Such variable displacement pumps are often equipped with pressure compensator controls for controlling or varying pump output pressure in response to system pressure.

A number of control systems are known which rely on load pressure of the system for controlling the displacement of the pump. However, these prior art systems fail to include sufficient variables to insure precise and continuous control of the displacement.

The prior art is exemplified by the following patents: U.S. Pat. No. 2,892,312 which issued to J. R. Allen et al on June 30, 1959, from an application filed on Jan. 27, 1958, and which is assigned to Deere & Company; U.S. Pat. No. 3,834,836 which issued to Allyn J. Hein et al on Sept. 10, 1974, from an application filed on Mar. 1, 1973, which is assigned to the assignee hereof; U.S. Pat. No. 3,797,245 which issued to Allyn J. Hein on Mar. 19, 1974, from an application filed on Aug. 25, 1972, which is assigned to the assignee hereof.

DETAILED DESCRIPTION OF THE INVENTION

Figure 1:
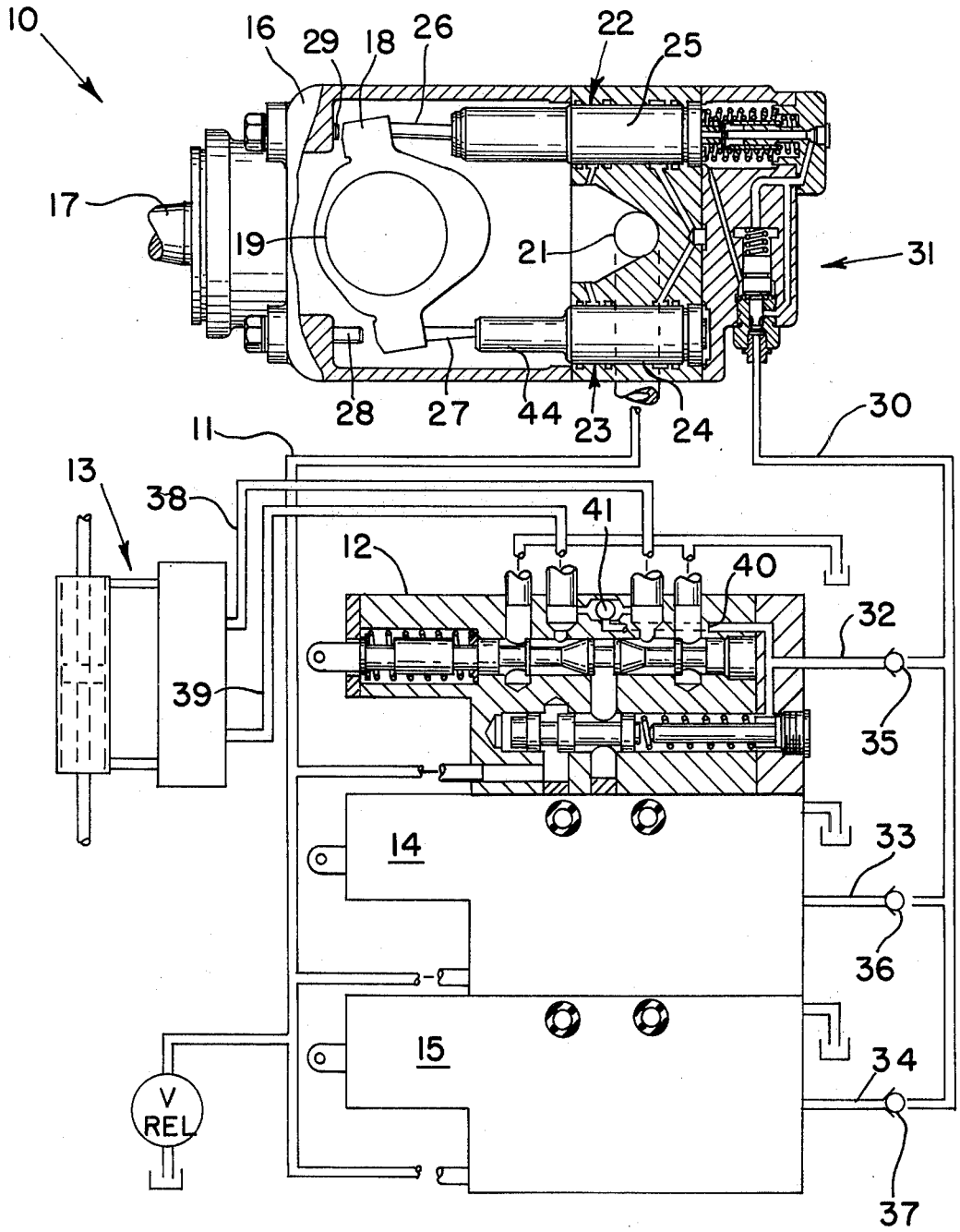
FIG. 1 is a diagrammatic view of a hydraulic system including a variable displacement pump incorporating a preferred embodiment of the present invention.

Referring to FIG. 1, a hydraulic system has a variable displacement pump 10 for supplying pressurized fluid via conduit 11 to a first distributor valve 12 for selectively directing fluid for operation of a motor 13 and to second and third distributor valves 14 and 15 for directing fluid for operation of other hydraulic motors (not shown). The variable displacement pump 10 and the operation thereof is best described in U.S. Pat. No. 3,834,836 issued Sept. 10, 1974, to Hein et al and assigned to the assignee hereof.

The pump has a housing 16 in which is mounted a pump cylinder barrel which is rotatably driven by a drive shaft 17 connected to a suitable prime mover, as is known in the art. The cylinder barrel includes a plurality of axially extending cylinders in which is disposed a plurality of reciprocating pistons which are guided by means of slipper pads or the like slidably mounted on support means in the form of a nonrotatable but tiltable swash plate 18 mounted by suitable means 19 for tilting about a horizontal axis. The amount of stroke or displacement of the pistons within the bores is determined by the amount of tilt of the swash plate, as is also known in the art.

The pump includes a head having an intake port, not shown, for drawing fluid into the cylinders from a suitable reservoir and an outlet port 21 for communicating pressurized fluid to conduit means 11. The head includes first and second cylindrical bores 22, 23 in which is mounted a first means or pressure reducing cartridge 24 and a second means or servo cartridge 25.

The pressure reducing cartridge 24 includes piston means connected by rod means 27 to the swash plate for biasing it toward a minimum displacement stop 28. The servo cartridge 25 includes rod means 26 connected to the swash plate 18 for biasing the swash plate 18 against a maximum displacement stop means 29.

The control means of the present system is responsive to a system load for providing one of the controlling functions for the displacement of the pump. The term "system load," as used herein, is the maximum load on any work element, for example, a motor controlled by distributor valves 12, 14, or 15. This load on a motor controlled by valve 12, 14, or 15 is measurable by the pressure in the respective motor control line connecting one of the valves to its respective motor. Here, the largest system of load valves 12,14 or 15 is utilized.

The load sensing means comprises conduit means 30 communicating at one end with a pressure-reducing valve 31 and communicating with branch conduits 32, 33, 34 which in turn communicate respectively with motor control lines of distributor valves 12, 14, 15. Each of the branch lines 32, 33, 34 include one-way check valves 35, 36, 37 to insure one-way communication of the fluid pressure from the maximum load to the load pressure reducing valve 31.

The valve 12 supplies pressurized fluid from conduit 11 to operate motor 13 via motor control conduits 38, 39. The conduits 38, 39 are connected to ports within the valve body which has a valve spool for providing communication. The brand conduit 32 is in communication with passage 40 of the valve 12. Passage 40 is in communication with conduits 38, 39 via resolver valve 41. Pressurized fluid therefore communicates from either one of conduits 38, 39 through resolver valve 41, passage 40, and branch conduit 32 with the main conduit 30 for communicating the pressurized fluid to the load pressure reducing valve 31. At valve 31, the pressure is reduced.

Figure 2:
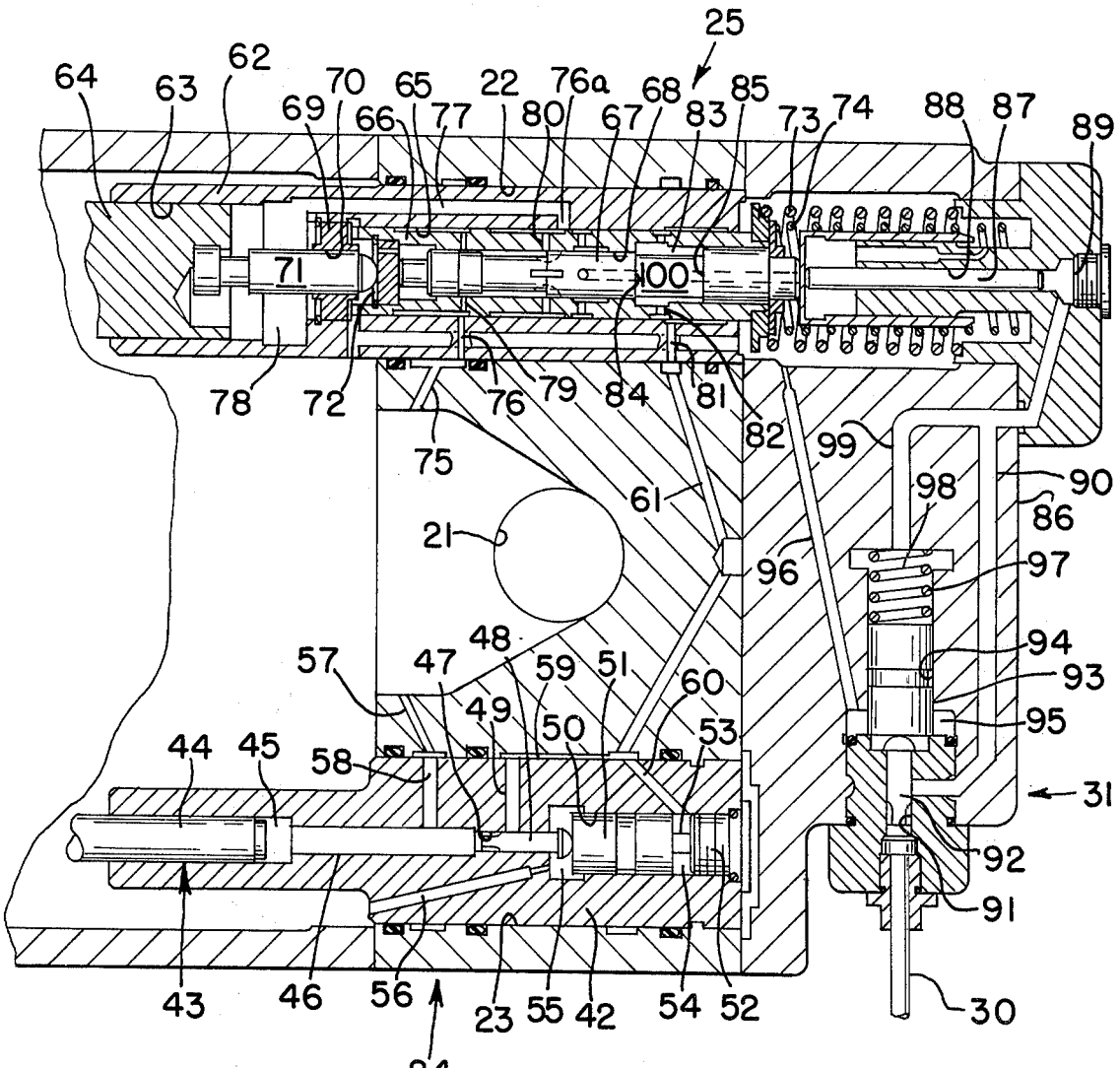
FIG. 2 is a diagrammatic view in partial section of a portion of a variable displacement pump embodying the preferred embodiment of the present invention.

Referring to FIG. 2, the first means or pressure reducing cartridge 24 includes a cylindrical housing 42 fitted within the second cylinder bore 23. The housing 42 includes a stepped diameter through bore for defining a series of connected cylinders and passageways. A first cylinder 43 has a reciprocal piston 44 defining a pressure chamber 45 at the head end of the piston 44. The piston 44 is connected to the swash plate 18 (see FIG. 1) via the rod member 27. A passage 46 connects the pressure chamber 45 with a second bore 47. The second bore 47 has a reciprocal valve member 48 for controlling or metering the flow of fluid from passageways 46, 49. A third bore 50 has a piston 51 for acting on valve member 48 and controlling the position thereof. A plug 52 is secured in the end of cylindrical bore 50 and includes stop means 53 for engaging the piston 51. A chamber 54 is defined by the end of the third bore 50 and piston 51 at the head end thereof.

A vent chamber 55 is formed at the foot end of piston 51. A vent passage 56 communicates case pressure to the piston 51 and vents the chamber 55 for movement of spool or piston 51 against valve member 48. A passage 57 communicates pressurized fluid from the outlet port 21 of the pump 10 to a passage 58 which is in communication with passage 46 for control of fluid to passage 49 by valve member 48. The fluid passes from passage 49 via passage 59 to passage 60 for communication with chamber 54 at the head end of piston 51. The pressurized fluid, communicated by way of passage 46 acts in chamber 45 on piston 44 for biasing the piston 44 outwardly and forcing the swash plate 18 in a direction toward the minimum displacement position. The fluid passing through valve member 48 is then communicated to the head end of piston 51 for acting on the valve member 48 and controlling the pressure of that fluid. The fluid is also communicated via passage 61 to the second cartridge 25.

The second servo cartridge 25 has a housing 62 mounted within the first cylinder bore 22. The housing 62 has a first cylindrical bore 63 in which is reciprocably mounted a piston 64 which is connected by rod 26 (see FIG. 1) to the swash plate 18. The housing 62 also has a second bore 65 in which is mounted a follow-up sleeve 66 for reciprocal movement therein.

A servo valve spool 67 is reciprocably mounted within a bore 68 of the sleeve 66. A retainer plug 69 is mounted within the bore 65 of housing 62 and has a bore 70. A rod 71 is reciprocably mounted within the bore 70 and is connected at one end to the piston 64 and bears at the other end against a plug 72 secured to the sleeve 66. The servo sleeve 66 therefore moves within the bore 65 following movement of piston 64. A compression spring 73 bears against the end of the sleeve 66 for biasing it against plug 69 and the servo valve spool 67 is biased via compression spring 74 against plug 72.

The relative positions of the sleeve 66 and spool valve 67 in the housing 62 controls communication of fluid between the high pressure outlet 21 of the pump 10 and chamber 78 via passages 75, 76, 79, 80, 76A, 77.

The fluid in chamber 78 acts on the head of piston 64. The position of the sleeve 66 is governed by the spring force of spring 73, the position of piston 64 and rod 71, and pressure in chamber 83.

The position of valve spool 67 within sleeve 66 controls communication between port 79 and port 80 which communicates with passage 76. Thus, the position of the spool as shown provides or permits communication between port 79 in communication with passage 76 and port 80 in communication with passage 76A. Upon movement of the spool 67 to the right, however, the communication between the port 79 and port 80 will be terminated which will cause the pressure acting on piston 64 to decrease by passing fluid to case drain through slots and a hole in spool 67, and permit piston 44 to overcome the force of piston 64 and swivel the swash plate to a lower displacement position.

The position of the spool 67 within the bore 68 of sleeve 66 is governed by the position of the sleeve 66 as well as pressure acting on the servo valve spool 67. This pressure acting on piston 100 is communicated via passage 61 to passage 81 which communicates with a passage 82 in sleeve 66 to a chamber 83 wherein the pressure acts on differential piston areas 84, 85 formed by a groove between two different diameters on spool 67. Since the area 85 is larger than area 84, the piston 100 will tend to be forced to the right against the force of spring 74. This pressure acting within chamber 83 on piston areas 84, 85 is the discharge pressure reduced by the first means 24 positioned downstream of the pump 10.

Housing member 86 mounted on the head of the pump 10 contains a piston 87 within a bore 88. This piston 87 is responsive to reduced load pressure communicated to a chamber 89 via passage 90 and reducing valve 31 for further acting on the valve spool 67 of the servo valve 25.

The load pressure reducing valve 31 includes an inlet bore 91 in which is mounted a valve member 92 controlled by piston 93 for controllably communicating fluid from conduit 30 to passage 90 which is in communication with piston 87. The piston 93 is mounted within bore 94 and includes a vent chamber 95 at the lower end thereof which is vented to the crankcase of the pump 10 via passage 96. A spring 97 disposed within chamber 98 biases the piston 93 toward the valve member 92. Passage 99 provides communication of the chamber 98 with passage 90.

The load pressure reducing valve 31 and associated equipment of this invention controllably reduce a load pressure of main conduit 30 for forming a modified load-pressure control signal, passing the modified load-pressure control signal via passage 90 to the servo valve 25 and imparting an additional biasing force on the servo valve 25 in response to said modified load-pressure control signal. The modified load-pressure control signal is delivered to the piston 87. Piston 87 is movable in response to the modified load-pressure control signal for controllably moving elements of the servo valve 25. The piston 87 is of a construction sufficient for biasing the swash plate in response to a modified load-pressure control signal greater than a preselected value.

Figure 3:
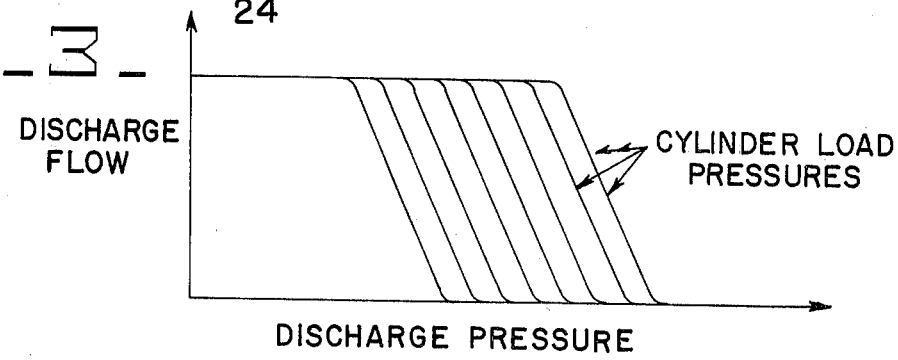
FIG. 3 is a diagrammatic plot of discharge flow versus discharge pressure with curves showing system load pressures.

Referring to FIG. 3, a graph of load pressure against discharge flow gives a series of curves representing cylinder load pressures. This illustrates the functioning of the system to maintain the pump discharge pressure at a predetermined level above the cylinder load pressure, thereby providing an infinite staging effect.

In the operation of the first and second means 24, 25 for controlling the position of the swash plate 18, as is known in the art, fluid discharging from the pump 10 is delivered to said means 24, 25 for control of the swash plate 18 through rod means 26, 27 in response to the pressure of the discharging fluid.

The magnitude of the biasing force subjected on the swash plate 18 via rod means 27 is responsive to the pressure of the fluid discharging from the pump 10.

The magnitude of the biasing force subjected on the swash plate 18 via rod member 26 is responsive to the pressure of the fluid discharging from the pump 10 and a preselected force imparted by spring means 73, 74 of the servo cartridge 25. The biasing force subjected in the swash plate 18 via the servo cartridge 25, as more fully described in the above-identified patents, is controlled in part by the positions of the sleeve 66 and valve spool 67 relative one to the other and to their associated housing 62.

As the fluid discharge pressure of the pump 10 decreases, the first and second means 24, 25 function to drive the swash plate 18 toward a maximum discharge position at which one end of the swash plate 18 is contacting stop element 29 and the other end of the swash plate 18 is spaced from stop element 28. As the fluid discharge pressure of the pump 10 increases, the first and second means 24, 25 functions to drive the swash plate 18 toward a minimum discharge position at which one end of the swash plate 18 is substantially contacting stop element 28 and the other end of the swash plate 18 is spaced from stop element 29.

By this construction, pump displacement is automatically controlled to maintain a preselected pump discharge pressure. That preselected discharge pressure is therefore responsive to the biasing force extended by spring means 73, 74. Changes in the preselected discharge pressure can therefore be made by changing springs 73, 74.

By adding the control means of this invention, the displacement of the pump is further controlled in response to the load pressure subjected upon the hydraulic system. As the load pressure increases over a preselected value, a controlled additional biasing force is subjected on the swash plate 18 by piston 87 via rod 26, valve spool 67, and sleeve 66 for driving the swash plate 18 toward the maximum displacement position thereby causing pump pressure to increase.

Therefore, by the apparatus of this invention, the pump can be automatically controlled to operate at discharge pressures that are more closely related to the system demands which will function to reduce waste.

Other aspects, objects, and advantages of this invention can be obtained from a study of the drawings, the disclosure, and appended claims.

What is claimed is:

1. In a piston pump assembly having a housing, an angularly adjustable swash plate for controlling the volume of fluid discharged from the pump, a servo valve having a biasing means and being positioned in contact with the swash plate at a location sufficient for biasing the swash plate toward one of a maximum or minimum fluid discharge position, and means positioned in contact with the swash plate at a location sufficient for biasing the swash plate toward the other fluid discharge position, said means being in communication with fluid discharging from the pump for biasing the swash plate toward the other fluid discharge position, said means being in communication with fluid discharging from the pump for biasing the swash plate in response to the pressure of the discharging fluid, said discharge pressure being reduced, the improvement comprising:

means for controllably reducing operating load pressures and forming a modified load-pressure control signal, passing the modified load-pressure control signal to the servo valve, and imparting a biasing force on the servo valve in response to said modified load-pressure control signal, said modified load pressure signal being of a value less than the value of the reduced discharge pressure acting upon the biasing means of the swash plate.

2. Apparatus, as set forth in claim 1, wherein the means comprises:

a piston positioned adjacent the servo valve and being movable in response to the modified load-pressure control signal for controllably moving said valve.

3. Apparatus, as set forth in claim 2, wherein the piston is of a construction sufficient for biasing the swash plate in response to a modified load-pressure control signal greater than a preselected value.

4. Apparatus, as set forth in claim 1, wherein the means has a conduit in fluid communication with fluid of a work element for passage of the load pressure to the means, and including:

a pressure reducing valve positioned in the conduit, and means for biasing the pressure reducing valve toward a closed position.

5. Apparatus, as set forth in claim 4, wherein the biasing means of the pressure reducing valve is a spring.

6. Apparatus, as set forth in claim 5, wherein the pressure reducing valve has a piston in fluid communication with the conduit at a location downstream of the pressure reducing valve for additionally biasing the pressure reducing valve toward the closed position.

* * * * *